US006010473A

United States Patent [19]

Robinson

[11] Patent Number: 6,010,473

[45] Date of Patent: Jan. 4, 2000

[54] REMEDIAL HAND WEAR ARTICLE FOR PREVENTING HYPEREXTENSION WITH FULL DISTAL KNUCKLE FLEXURE

[76] Inventor: Margaret E. Robinson, 4996 Concord Glen Dr., Cincinnati, Ohio 45244

[21] Appl. No.: 09/100,165

[22] Filed: Jun. 18, 1998

Related U.S. Application Data

[63] Continuation of application No. 08/775,350, Jan. 3, 1997, abandoned, which is a continuation of application No. 08/498,685, Jul. 3, 1995, abandoned, which is a division of application No. 08/259,175, Jun. 13, 1994, Pat. No. 5,476,439.

[51] Int. Cl.[7] ..... A61F 5/058; A61F 5/10; A61F 5/37

[52] U.S. Cl. ..... 602/21; 602/22; 2/161.6; 128/880

[58] Field of Search ..... 602/21, 22; 601/40; 2/160, 161.1, 161.2, 161.5, 161.6, 161.7; 125/878–880; 273/188, 189 R, 189 A; 482/44, 47–49, 124; 473/61, 62

[56] References Cited

U.S. PATENT DOCUMENTS

| | | | |
|---|---|---|---|
| 1,469,315 | 10/1923 | Hansard | 602/21 |
| 2,025,357 | 12/1935 | Pagan | 2/161.6 |
| 2,863,449 | 12/1958 | Spencer | 602/21 |
| 3,299,887 | 1/1967 | Czap | 602/21 |
| 4,173,218 | 11/1979 | Cronin . | |
| 4,366,812 | 1/1983 | Nuzzo . | |
| 4,445,507 | 5/1984 | Eisenberg . | |
| 4,675,914 | 6/1987 | Mitchell | 2/161.2 |
| 4,706,658 | 11/1987 | Cronin | 602/21 |
| 4,765,320 | 8/1988 | Lindemann et al. | 602/22 |
| 4,781,178 | 11/1988 | Gordon | 602/22 |
| 4,830,360 | 5/1989 | Carr, Jr. | 601/40 |
| 5,058,576 | 10/1991 | Grim et al. . | |

FOREIGN PATENT DOCUMENTS

| | | | |
|---|---|---|---|
| 296148 | 1/1917 | Germany | 602/21 |

*Primary Examiner*—Danton D. DeMille
*Attorney, Agent, or Firm*—Charles R. Wilson

[57] ABSTRACT

A remedial hand wear article is for use by individuals who have suffered nerve damage which diminishes use of the hand. The article comprises (a) a glove for comfortably fitting onto a hand of an individual, (b) an enclosure permanently attached on the glove's top side and superimposed over at least one finger of the glove, and (c) a substantially rigid member positioned within the enclosure and contoured to follow the shape of a top of the individual's hand and to be operably associated with at least one finger of the individual to hold the at least one finger in a desired position and so that full finger flexure at proximal and distal knuckles is retained. The hand wear article is designed to remedy problems caused by different nerve damage in that one to five enclosure elongated sections are permanently attached over glove fingers depending on which finger(s) of the individual is affected by the damaged nerve. The glove portion of the hand wear article provides comfort to the user while also serving to lessen the noticeability of any hand or finger grotesqueness.

12 Claims, 3 Drawing Sheets

REMEDIAL HAND WEAR ARTICLE FOR PREVENTING HYPEREXTENSION WITH FULL DISTAL KNUCKLE FLEXURE

This is a continuation of "Remedial Hand Wear Article With Rigid Restraining Member", Ser. No. 08/775,350, filed Jan. 3, 1997, now abandoned which is a continuation of "Remedial Hand Wear Article With Rigid Restraining Member", Ser. No. 08/498,685, filed Jul. 3, 1995, now abandoned, which is a division of "Remedial Hand Wear Article", Ser. No. 08/259,175, filed Jun. 13, 1994, now U.S. Pat. No. 5,476,439.

FIELD OF INVENTION

This invention relates to a remedial hand wear article. More particularly, the invention relates to a remedial hand wear article for use by individuals who have suffered nerve damage in an arm, wrist or hand.

BACKGROUND OF INVENTION

Individuals occasionally suffer injuries to the arm, wrist or hand which damage one or more nerves. A nerve can be crushed in which individual fibers within the nerve may be severed while a nerve trunk remains intact. The severed fibers degenerate and lead to loss of power in the muscles and loss of sensation in the skin area supplied by the fibers. New fibers can regenerate and eventually the individual may regain all normal muscle and sensation functions. A fully severed nerve requires surgical repair. The recovery period is longer. Most importantly, during the healing process it is necessary that the affected areas be protected and that constant hand therapy be administered. The therapy is needed to keep muscles, tendons and joints affected by the nerve damage healthy and free from contractures.

Depending on which nerve leading to the hand is damaged and the extent of the damage, the individual will experience diminished use of the hand and one or more fingers. The diminished use can manifest itself by weakened wrist and finger movements such that the hand is incapable of significant use. Diminished use of one or more fingers will affect the individual's ability to grasp objects or perform other finger manipulations which are taken for granted. Besides the diminished physical use of the hand or fingers, the nerve damage can result in the hand or fingers drooping and/or hyperextending in a noticeably unnatural manner. This unnatural appearance alone can be a concern to the individual.

Certain diseases also inflict the nerves that control the hand. Here also, surgery and/or hand therapy can help the individual regain partial or full use of the hand or fingers.

Many medical devices are available to alleviate or correct problems with the hand or fingers. Some hand wear articles such as described in U.S. Pat. Nos. 4,366,812 and 5,058,576 are intended for short term use primarily to immobilize a bone while it mends. Other hand wear articles are for use by individuals who suffer from rheumatoid arthritis. These articles are primarily intended to rigidly hold fingers in a natural position against the deforming forces of arthritis. U.S. Pat. Nos. 4,173,218 and 4,781,178 describe two such articles. There also have been developed hand wear articles which are intended to restrict thumb movement while it is healing from a prior ligament injury. An example of such an article is found described in U.S. Pat. No. 4,445,507.

There is presently a need for a remedial hand wear article which is able to alleviate the discomfort and diminished use of a hand or fingers caused by some form of nerve damage. The article must be capable of its intended use. It must be comfortable to wear and have a natural appearance so as to encourage its use. It also must be economical to manufacture. In accord with the need, there has been developed a remedial hand wear article which meets the recognized needs of many individuals who have suffered nerve damage.

SUMMARY OF INVENTION

A remedial hand wear article comprises (a) a glove for comfortably fitting onto a hand of an individual, (b) an enclosure superimposed on a top side of the glove and permanently attached thereto, and (c) a substantially rigid member positioned within the enclosure and operably associated with a finger of the individual to position that finger in a desired posture. The hand wear article is designed to remedy problems caused by different nerve damage in that the enclosure extends over one to five fingers of the glove depending on which finger(s) of the individual is affected by the damaged nerve. The glove portion of the hand wear article provides comfort to the user while also serving to lessen the noticeability of any hand or finger grotesqueness. A proximal knuckle of at least one finger is blocked to prevent hyperextension, while the proximal knuckle and the distal knuckles of the finger are capable of full anatomical finger flexure.

DETAILED DESCRIPTION OF INVENTION

The remedial hand wear article of the invention is described in the following paragraphs and with reference to the drawings. The article is versatile in that it can be configured to remedy different nerve damage effects. A single finger ranging up to all the fingers can be affected by a particular injury and can be remedied by the remedial hand wear article. As used throughout, the commonly called thumb, index finger, middle finger, ring finger and little finger are referred to as the first, second, third, fourth and fifth fingers, respectively.

An individual's hand and finger muscles are controlled by a set of peripheral nerves known as the radial nerve, median nerve and ulnar nerve. The radial nerve leads to extensor muscles of the arm and forearm and controls all five fingers. The median nerve controls the first, second and third fingers. The ulnar nerve controls the fourth and fifth fingers. Movements of the wrist and fingers are affected by damage to one or more of the radial, median and ulnar nerves. The damage is manifested by wrist drop as well as hyperextension and/or diminished abduction, adduction and extension of possibly all the fingers. One or more of the effects result depending on the nerve damaged.

In accord with the invention, the remedial hand wear article is configured based on the individual's particular nerve damage and consequent needs. In all cases, the remedial hand wear article blocks the first or proximal knuckle of the affected finger from hyperextension while the proximal knuckle and the distal knuckles of the affected finger are permitted full anatomical finger flexure. As commonly understood, full anatomical finger flexure means the individual has normal use of his or her finger as is commonly found with all other healthy individuals.

Figure 1:
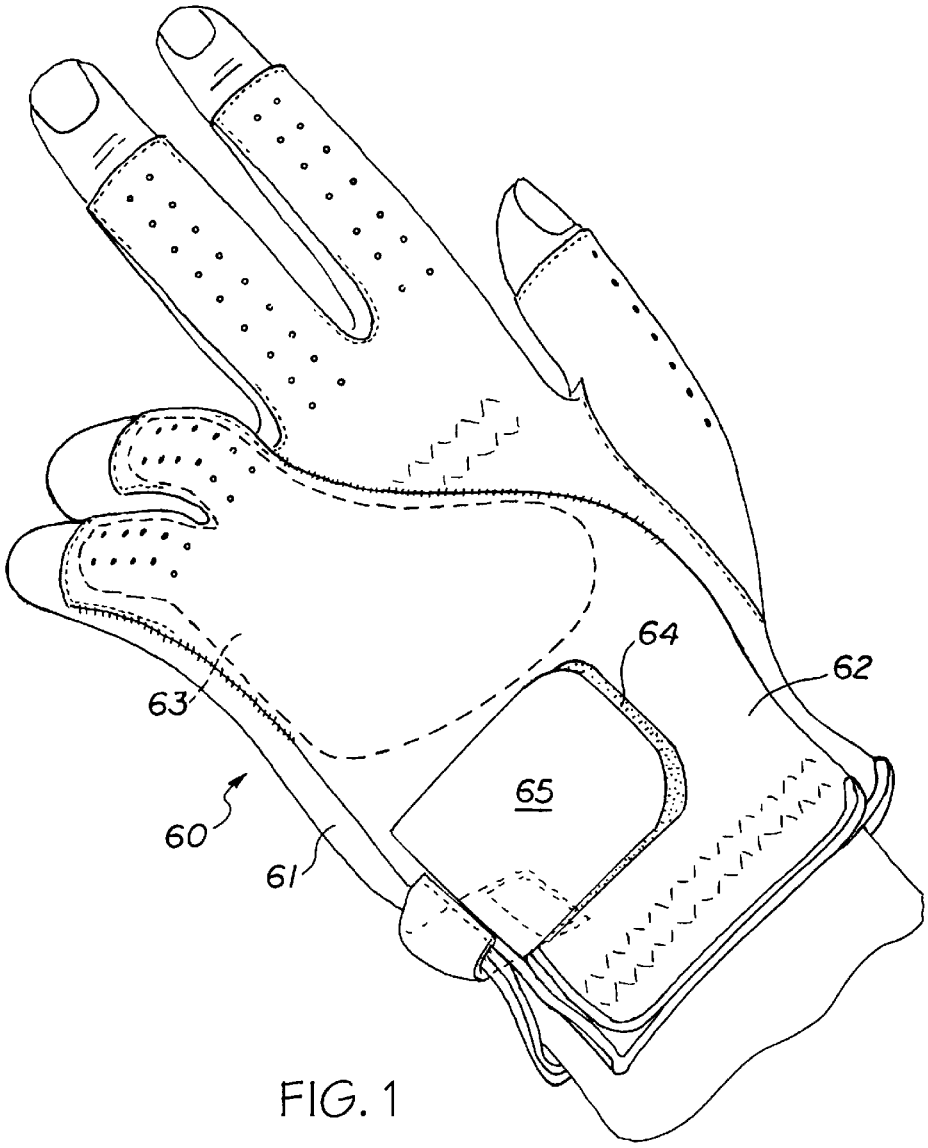
FIG. 1 is a perspective view of a remedial hand wear article of the invention intended for use by an individual with ulnar nerve damage.
Figure 2:
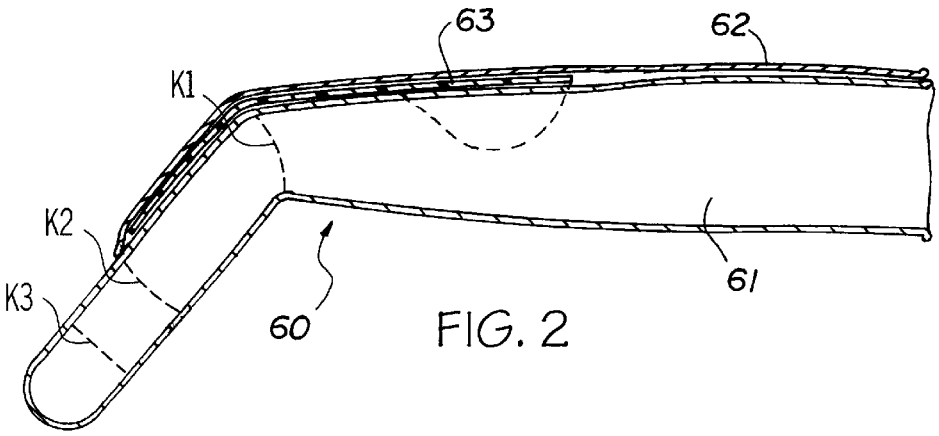
FIG. 2 is an elevational view in section of the remedial hand wear article of FIG. 1 showing the ability of the article to allow full anatomical flexure of all knuckles of a finger.

With respect to FIGS. 1 and 2, there is shown a remedial hand wear article 60 of the invention for use by an individual who has suffered ulnar nerve damage. The ulnar nerve controls the fourth and fifth fingers. These two fingers tend to hyperextend at the proximal joints when the ulnar nerve is damaged. This causes a clawing deformity at the distal joints. If not controlled, the fingers will be permanently distorted in that position.

The remedial hand wear article 60 comprises a glove 61, an enclosure 62 superimposed over the fourth and fifth fingers of the glove and over a portion of the back hand side of the glove, and a restraining member in the form of a substantially rigid member 63 positioned in the enclosure 62. The glove 61 is conventional. It has a typical glove construction such as found with winter gloves for cold weather use or safety gloves for the workplace.

The glove 61 is constructed to fit comfortably onto the user's hand. It has a back hand side, palm side, and five fingers extending therefrom. The parts of the glove are sewn or otherwise held together to form a one-piece item which encompasses an individual's hand when worn. Its fingertips have been optionally removed from the first, second and third fingers so that the individual will be able to experience touch sensation. Sensations are lost in the individual's fourth and fifth fingers. Accordingly, it is highly preferred that the glove's fourth and fifth fingers remain intact because of the protection they afford against the individual inadvertently damaging an exposed finger. This can easily occur by touching a hot or excessively cold item and not immediately realizing the damage being done because of the lack of touch sensation.

The enclosure 62 superimposed on the glove 61 and permanently attached thereto is to accommodate the substantially rigid member 63. The enclosure is open bottom and is sewn along its edges to the top side of the glove 61. Other means of attaching the enclosure such as heat sealing and adhesive are also possible. The enclosure has two elongated sections that overlie the fourth and fifth fingers of the glove. It also has a planar section that overlies generally an outside half of the glove's back hand side. The elongated sections and planar section are in communication and together represent a single enclosure. The substantially rigid member 63 which is positioned within the enclosure is shaped to follow the contour of the user's back hand and the fourth and finger top sides up to each finger's second knuckle when the finger is slightly bent at the first knuckle. With reference to FIG. 2, the rigid member in the remedial hand wear article 60 ensures that the operably associated fingers of the user are not able to hyperextend at the first i.e. proximal knuckle K1 of the fourth and fifth fingers while allowing full anatomical flexure at the first knuckle and the second and third knuckles i.e. distal knuckles K2 and K3. This ensures against a permanent claw deformity to the two fingers.

A retention member is used to hold the glove 61 of the article 60 in position during use. It has a hook and loop fastener strap 64 positioned on the glove's back side near the wrist end. It also has a mating hook and loop fastener strap 65 attached at one end to the glove and having a length to wrap around the wrist of the user and mate with the fastener strap 64.

Figure 3:
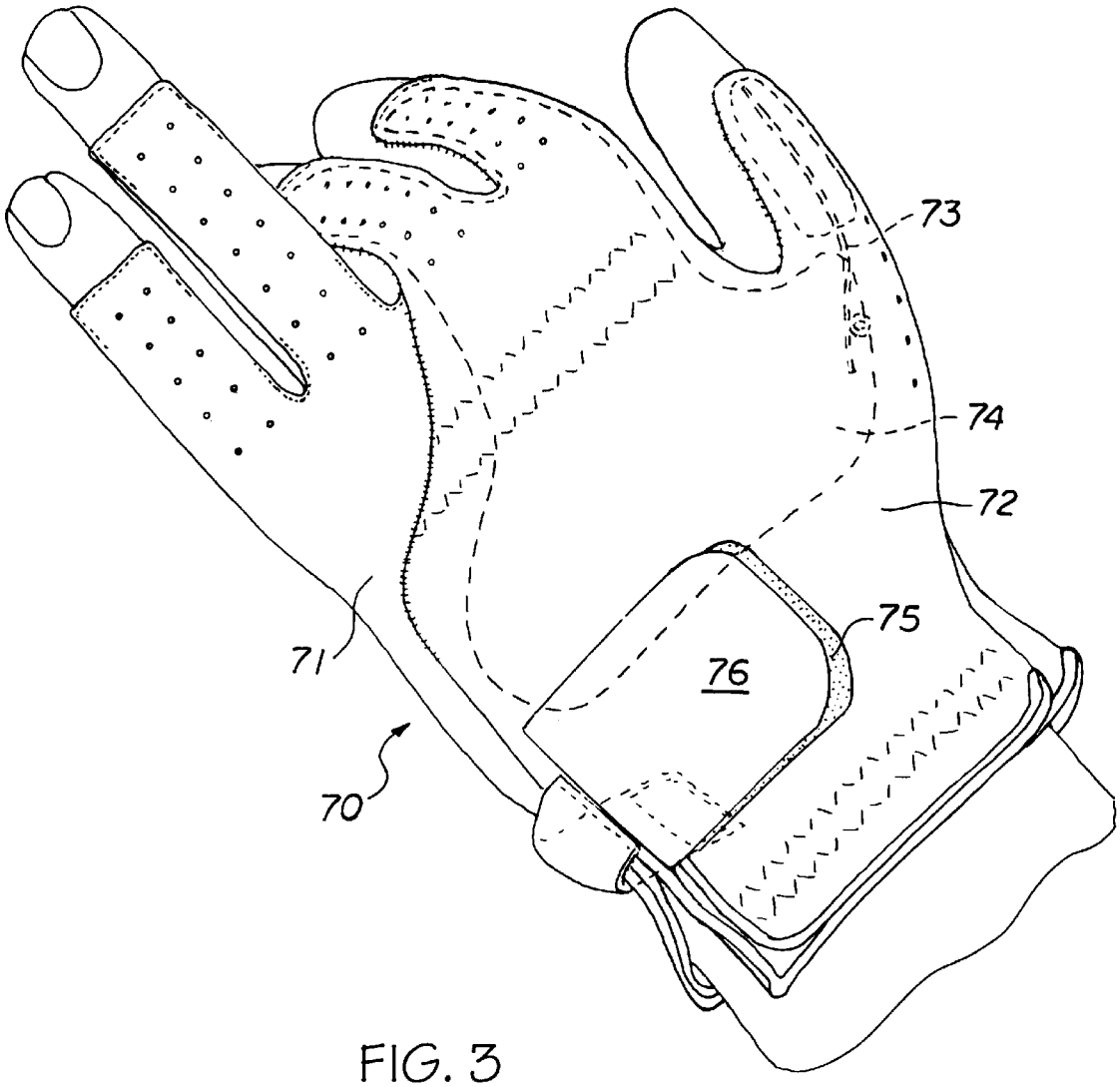
FIG. 3 is a perspective view of a remedial hand wear article of the invention intended for use by an individual who has suffered median nerve damage.

FIG. 3 illustrates a remedial hand wear article 70 of the invention intended for use by an individual who has suffered median nerve damage. The individual has weak or nonexistent first finger abduction and opposition. This results in the inability to bring the first finger away from the palm area of the hand and to reach the first finger over to the fifth finger. Mild hyperextension of the first knuckle in the second and third fingers may result as well. Touch sensation in the three aforementioned fingers is diminished.

The remedial hand wear article 70 includes a glove 71 and an enclosure 72 superimposed over the back hand side of the glove and over the first, second and third fingers thereof. A spring wire 73 is positioned in that part of the enclosure overlying the first finger and a substantially rigid member 74 is positioned in that part of the enclosure overlying the second and third fingers.

The glove 71 is similar in construction to that described above, though those fingertips which are susceptible to damage because of the diminished touch sensation are closed. The enclosure 72 is shaped to cover substantially the full back side of the glove and the first, second and third fingers of the glove. The substantially rigid member 74 is dimensioned and shaped to follow the contour of the user's back hand, and second and third finger top sides when held in a generally straight manner. The spring wire 73 is permanently attached at one end to an edge of the rigid member 74. The spring wire 73 illustrated includes a looped end permanently attached to the rigid member 74. Preferably, the looped end of the spring wire 73 is embedded in the rigid member 74. Mechanical and adhesive attachment means can as well be used for this purpose. It extends the length of the enclosure's elongated section which overlies the first finger of the glove.

A padding material (not shown) preferably encompasses the spring wire 73 for comfort and protection. Such padding can be a synthetic polymeric foam, fibrous material, or other commercially available force absorbing material. It is secured to the wire in a conventional manner. The article 70 also has a retention member comprised of mating hook and loop fastener straps 75 and 76 at the glove's wrist end.

It should be evident the spring wire 73 in the remedial hand wear article 70 forces the first finger into an abducted state. This allows flexion of the first finger for functional pinch. The substantially rigid member 74 when positioned in the enclosure 72 of the article 70 prevents hyperextension at the proximal knuckles, therefore protecting against any clawing deformities to the distal knuckles of the second and third fingers. At the same time, the proximal and distal knuckles have full anatomical flexure inwardly towards the palm of the individual in a natural manner.

Figure 4:
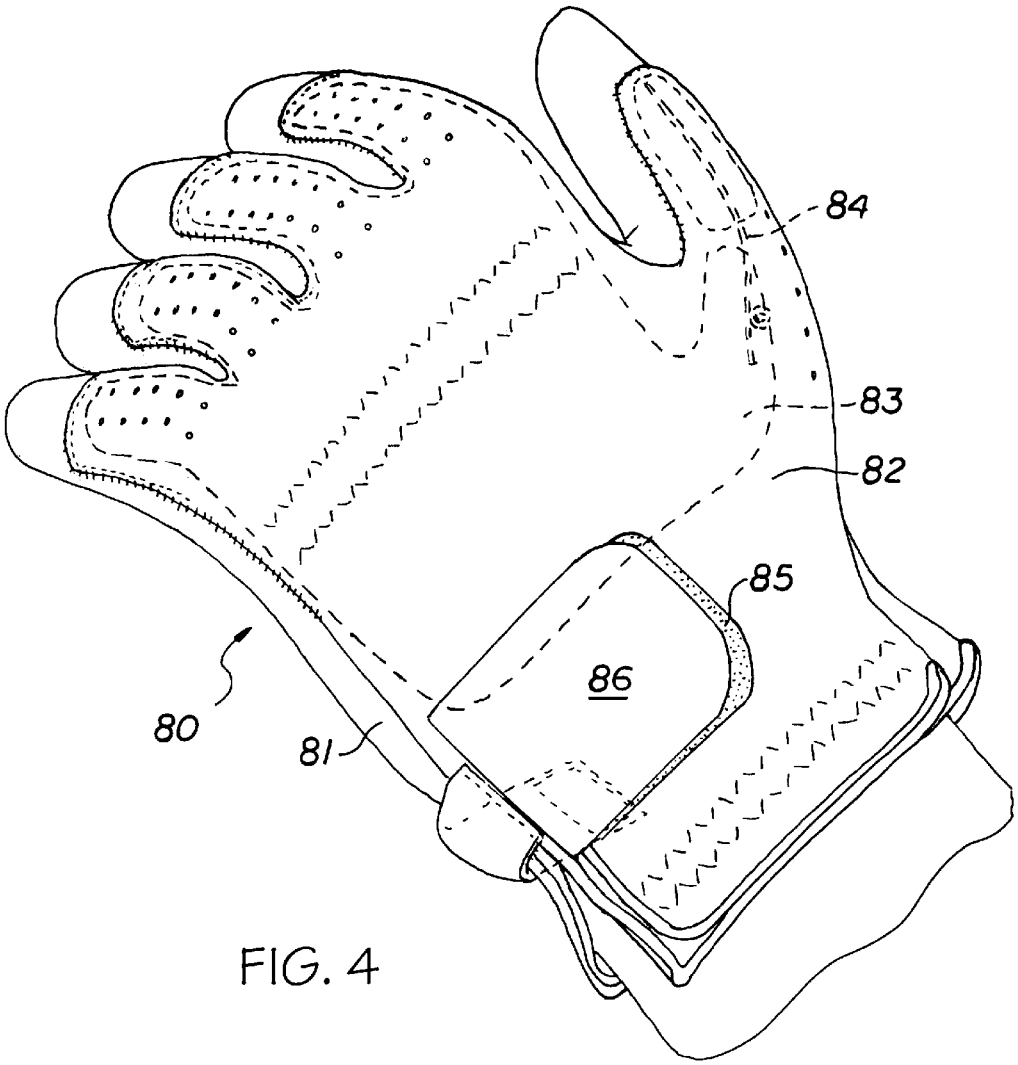
FIG. 4 is a perspective view of a remedial hand wear article of the invention intended for use by an individual who has suffered ulnar and median nerve damage.
Figure 5:
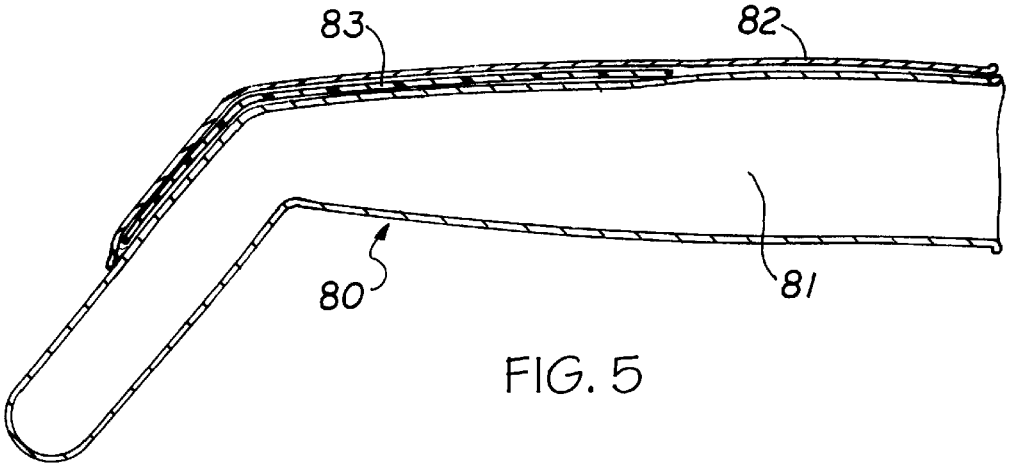
FIG. 5 is an elevational view in section of the remedial hand wear article of FIG. 4.

FIGS. 4 and 5 illustrate a remedial hand wear article intended for use by those individuals who have suffered both median and ulnar nerve damage. The article 80 basically combines the features found with the remedial hand wear articles 60 and 70 discussed above and with reference to FIGS. 1, 2 and 3.

The remedial hand wear article 80 comprises a glove 81, an enclosure 82, a substantially rigid member 83, and a spring wire 84. The glove is as described above. The enclosure 82 is shaped such that it covers substantially the full back hand side of the glove and all its fingers. The enclosure 82 is superimposed on the glove and permanently attached thereto. The substantially rigid member 83 is dimensioned and shaped to follow the contour of the back side of the user's hand, including the top side of the second through fifth fingers. The finger portions are slightly bent downwardly to block the individual's second, third, fourth and fifth fingers from claw deformity or hyperextension at proximal knuckles. A spring wire 84 attached at one end to the rigid member 83 extends into the enclosure's elongated section overlying the first finger of the glove. Its nature and function are as described above with a corresponding component found in the remedial hand wear article 70. The retention member comprised of mating hook and loop fastener straps 85 and 86 is the same as described above with the other articles. It is positioned on the glove near its wrist end and is to hold the article firmly in position during use.

While the invention has been described in detail and with particular reference to the drawings, it should be understood various changes and modification of an obvious nature can be made. All such changes and modifications are considered within the scope of the appended claims.

I claim:

1. A remedial hand wear article for use by an individual afflicted with nerve damage for preventing hyperextension at a proximal knuckle of at least one finger, yet allowing flexure at a proximal knuckle and distal knuckles of the finger, said hand wear article comprising:

(a) a glove having a back hand side, a palm side and five fingers extending therefrom for comfortably fitting onto a hand of the individual;

(b) an enclosure superimposed over the glove and permanently attached thereto, said enclosure having a planar section over the back hand side of the glove and at least one elongated section over a top side portion of a finger of the glove; and (c) a substantially rigid member positioned within the planar section and extending into the at least one elongated section of the enclosure, said substantially rigid member contoured to follow the shape of the planar section of the enclosure and the at least one elongated section of the enclosure whereby when the article is worn by the individual the at least one finger of the individual at the proximal knuckle is blocked so as to prevent the hyperextension and further whereby the at least one finger of the individual at the proximal knuckle and the distal knuckles is capable of full anatomical finger flexure inwardly towards a palm of the individual in a natural manner.

2. The remedial hand wear article of claim 1 further having a retention member positioned thereon near a wrist end of the glove for snugly holding the article to the individual during use.

3. The remedial hand wear article of claim 2 wherein the retention member is a set of mating hook and loop fastener straps.

4. The remedial hand wear article of claim 3 wherein the enclosure superimposed over the top side of the glove has an elongated section over each of the fingers of the glove.

5. The remedial hand wear article of claim 1 wherein the at least one elongated section of the enclosure comprises an elongated section over a top side portion of a fourth finger of the glove and an elongated section over a top side portion of a fifth finger of the glove and further the substantially rigid member extends into said elongated sections.

6. A remedial hand wear article for use by an individual afflicted with nerve damage, said hand wear article comprising:

(a) a glove having a back hand side, a palm side and five fingers extending therefrom for comfortably fitting onto a hand of the individual;

(b) an enclosure superimposed over the glove and permanently attached thereto, said enclosure having a planar section over the back hand side of the glove and an elongated section over a top side portion of a fourth finger and an elongated section over a top side portion of a fifth finger of the glove;

(c) a substantially rigid member positioned within the planar section and extending into the two elongated sections of the enclosure, said substantially rigid member contoured to follow the shape of the planar section and the elongated sections of the enclosure whereby the substantially rigid member prevents hyperextension in fingers of the individual at proximal knuckles thereof, yet allows full anatomical flexure in the fingers at the proximal knuckle and the distal knuckles thereof.

7. The remedial hand wear article of claim 6 further having a retention member positioned thereon near a wrist end of the glove for snugly holding the article to the individual during use.

8. The remedial hand wear article of claim 7 wherein the retention member is a set of mating hook and loop fastener straps.

9. A remedial hand wear article for use by an individual afflicted with nerve damage for preventing hyperextension at a proximal knuckle of at least one finger, yet allowing flexure at proximal and distal knuckles of the finger, said hand wear article comprising:

(a) a glove having a back hand side, a palm side and five fingers extending therefrom for comfortably fitting onto a hand of the individual;

(b) an enclosure superimposed over the glove and permanently attached thereto, said enclosure having a planar section over the back hand side of the glove and at least one elongated section over a top side portion of a finger of the glove; and (c) a substantially rigid member positioned within the planar section and extending into the at least one elongated section of the enclosure, said substantially rigid member contoured to follow the shape of the planar section of the enclosure and to extend into the at least one elongated section of the enclosure whereby when the article is worn by the individual the substantially rigid member covers the individual's back hand and the at least one finger up to a second knuckle so that the at least one finger of the individual at the proximal knuckle is blocked to prevent the hyperextension and further whereby the at least one finger of the individual at the proximal and the distal knuckles is capable of full anatomical finger flexure inwardly towards a palm of the individual in a natural manner.

10. The remedial hand wear article of claim 9 further having a retention member positioned thereon near a wrist end of the glove for snugly holding the article to the individual during use.

11. The remedial hand wear article of claim 10 wherein the retention member is a set of mating hook and loop fastener straps.

12. The remedial hand wear article of claim 9 further wherein a portion of the substantially rigid member which extends into the at least one elongated section of the enclosure is bent whereby said portion of the substantially rigid member follows the user's finger up to a second knuckle thereof when held in a natural manner.

* * * * *